US007717649B2

(12) United States Patent
Li et al.

(10) Patent No.: US 7,717,649 B2
(45) Date of Patent: May 18, 2010

(54) SUSPENDING HYDRAULIC PILLAR

(75) Inventors: Bingwen Li, Xuzhou (CN); Jiyun Zhao, Xuzhou (CN); Qiguang Wang, Xuzhou (CN); Shiqi Chen, Xuzhou (CN); Jianwu Wang, Xuzhou (CN); Weimin Chen, Xuzhou (CN)

(73) Assignee: China University of Mining and Technology (CN)

( * ) Notice: Subject to any disclaimer, the term of this patent is extended or adjusted under 35 U.S.C. 154(b) by 265 days.

(21) Appl. No.: 12/083,744

(22) PCT Filed: Dec. 31, 2005

(86) PCT No.: PCT/CN2005/002422

§ 371 (c)(1),
(2), (4) Date: Apr. 16, 2008

(87) PCT Pub. No.: WO2007/051366

PCT Pub. Date: May 10, 2007

(65) Prior Publication Data

US 2009/0257831 A1 Oct. 15, 2009

(30) Foreign Application Priority Data

Oct. 31, 2005 (CN) ..... 2005 1 0095108

(51) Int. Cl.
*E21D 15/44* (2006.01)

(52) U.S. Cl. ..... 405/290; 405/288; 405/294; 248/354.1

(58) Field of Classification Search ..... 405/288, 405/290, 291, 292, 294; 248/351, 354.1
See application file for complete search history.

(56) References Cited

U.S. PATENT DOCUMENTS 4,252,476 A * 2/1981 Koppers et al. ..... 405/290
5,051,039 A * 9/1991 Heiliger ..... 405/290
5,205,676 A * 4/1993 Heiliger ..... 405/290
5,297,901 A * 3/1994 Voss ..... 405/290
5,348,425 A * 9/1994 Heiliger ..... 405/290
5,611,646 A * 3/1997 Voss ..... 405/290

FOREIGN PATENT DOCUMENTS

CN 85 2 00085 U 11/1985
CN 2596014 Y 12/2003
CN 2660127 Y 12/2004
CN 1584291 A 2/2005
DE 3904644 C1 * 3/1990

OTHER PUBLICATIONS

International Search Report, dated Jun. 29, 2006, corresponding to PCT/CN2005/002422.

* cited by examiner

*Primary Examiner*—Frederick L Lagman
(74) *Attorney, Agent, or Firm*—Christie, Parker & Hale, LLP

(57) ABSTRACT

A suspending hydraulic pillar includes an oil cylinder, a movable prop, a handle-valve body, a reset spring, a top cover, a bottom seat, a three-way valve, a position-limiting steel wire, and a guide ring. The handle-valve body is provided between a port of the oil cylinder port and the moveable prop. Position-limiting steel wire, a guiding ring, and an oil inlet is located on a lower part of the moveable prop. The three-way valve is provided in the handle-valve body. A dust-prevention ring and a sealing ring are provided between the handle-valve body, the movable prop, and the oil cylinder. The handle-valve body is fixed on the oil cylinder by means of a connecting steel wire. The handle-valve body does not move up and down as the movable prop telescopically extends or contracts. The suspending hydraulic has good stability, high strength and supporting force, good sealing, and high anti-erosive capability.

5 Claims, 4 Drawing Sheets

SUSPENDING HYDRAULIC PILLAR

CROSS-REFERENCE TO RELATED APPLICATION(S)

This application claims priority to and the benefit of China Patent Application No. 200510095108.4, filed on Oct. 31, 2005, and PCT Patent Application No. PCT/CN2005/002422, filed on Dec. 31, 2005, both of which were filed in the China Patent and Trademark Office.

FIELD OF THE INVENTION

The present invention relates to a suspending hydraulic pillar, which is particularly suitable for support of underground mining face, and is also applicable to other occasions in need of support.

BACKGROUND OF THE INVENTION

Support of underground mining face is one of indispensable equipments in mining. The support equipment adopted in China includes various forms, such as wooden pillar, single frictional metal pillar, single hydraulic pillar, and dual-extension hydraulic pillar, etc. In recent years, owning to continuous research and practice effort of the engineers, the support technique gains significant development; the wooden pillar is rarely adopted; the single fractional metal pillar is also rarely used due to its poor and uniform setting load and uncertain constant increasing resistance lowering distance; the single hydraulic pillar is a new product developed after the single fractional metal pillar, and has been applied for more than 30 years. The single hydraulic pillar is provided with three-way valve, and hydraulic fluid supplied by emulsion station preset by working face is injected into oil cylinder of pillar via the three-way valve for initial support; when pressure is applied to the top plate and released, the emulsion is then discharged via the three-way valve, and the pillar is lowered; the hydraulic fluid from the emulsion station is reused in repeat work for initial support. The application of the single hydraulic pillar brings great convenience for the mining face, but issues as below still exist: 1) arc welding seam is provided on movable prop, which leads to lowered mechanical strength of the movable prop; when pressure is applied on the top plate, the welding seam is prone to fracture and crack, which is a potential safety hazard; 2) after wearing of the cylinder inner surface which is high pressure sealed surface, inner leakage of the pillar may occur, which is a potential safety hazard for mining workers; 3) the emulsion quality is not guaranteed due to poor underground water quality in coal mine, which leads to severe corrosion to the cylinder and the pillar failure; the quantity of failed pillars is about 300,000 each year, which is a dramatic waste. Now most coal mines adopt single hydraulic pillar, the demand for single hydraulic pillar is over 2,000,000 each year, therefore it is very important to further modify and improve the single support equipment.

SUMMARY OF THE INVENTION

As the available techniques have aforementioned disadvantages, the object of the present invention is to provide a suspending hydraulic pillar which has improved structure, low vulnerability to stuck, low cost, high strength, good application effect, and long service life.

The inventive suspending hydraulic pillar comprises a top cover and a movable prop, a sealing cover is arranged in the movable prop, the movable prop is arranged in an oil cylinder; a handle-valve body is arranged between the oil cylinder port and the movable prop; a reset spring is connected with the sealing cover; an oil inlet is arranged on the movable prop; a three-way valve is arranged in the handle-valve body; a dust-prevention ring, a seal ring, and a connecting steel wire are arranged between the handle-valve body and the movable prop and the oil cylinder; and an oil inlet is provided for connecting the oil cylinder and the three-way valve; a seal ring and a connecting steel wire are arranged between the cylinder bottom seat and the oil cylinder; a gasket is arranged below the sealing cover in the movable prop, the gasket is provided with several through holes; outer ring of the gasket is disposed against the shoulder of the movable prop inner diameter; the movable prop outer diameter is provided with a position-limiting steel wire and a guiding ring which are fitted on the groove of the movable prop outer diameter; a guiding ring is provided between the handle-valve body and the movable prop; all the sealing rings are provided with retaining rings therein; the outer cylinder radial direction of the sealing cover is provided with through hole matching drilling with the top cover and the movable pillar, and an elastic cylindrical pin is arranged in the through hole.

The inventive suspending hydraulic pillar has said sealing cover lower end face in shape of plane or cone flat bottom. The sealing cover with lower end face in shape of cone flat bottom is provided with a connecting steel wire at jointing face between the top cover and the movable prop.

The inventive suspending hydraulic pillar comprises a top cover, a movable prop, and an oil cylinder cooperating with the movable prop; a handle-valve body arranged between an oil cylinder port and a movable prop, a reset spring, an oil inlet on the movable prop; a three-way valve arranged in the handle-valve body; a dust-preventing ring, a sealing ring, and a connecting steel wire provided between the handle-valve body and the movable prop and the oil cylinder; an oil inlet for communicating the oil cylinder and the three-way valve; a sealing ring and a connecting steel wire arranged between the cylinder bottom seat and the cylinder; an upper hanging ring arranged in the movable prop, connected with the reset spring, and directly welded on inner wall of the top cover; a sealing ring and a connecting steel wire arranged between the top cover and the movable prop fitting face; a position-limiting steel wire and a guide ring arranged on outer diameter of the movable prop which are fit on groove of the movable prop outer diameter; a guiding ring arranged between the handle-valve body and the prop; and retaining rings arranged in all the sealing rings.

The inventive suspending hydraulic pillar is particularly suitable for support of underground mining face. It mainly comprises oil cylinder, movable piston, handle-valve body, reset spring, top cover, bottom seat, and three-way valve. The handle-valve is arranged between the oil cylinder port and the movable prop, and position-limiting steel wire and guide ring are arranged at lower part of the outer diameter of the movable prop with an oil inlet. The arc base and movably connected pin are arranged on the top cover; the three-way vale is mounted on the handle-valve body; the dust-preventing ring and sealing member are provided between the handle-valve body and the movable prop and the oil cylinder, and provided with connecting steel wire for fixing them on the oil cylinder; the handle-valve body does not move up or down along with telescopic extension/contraction of the movable prop; the sealing cover is optionally arranged in the movable prop. The gasket with through holes is arranged in the movable prop with the sealing cover, and the reset spring is connected with the sealing cover. In the movable prop without the sealing cover, the reset spring and the top cover are connected. The invention can ensure strength of the movable prop, reduce weight of the pillar, and also reduce wearing caused by relative movement between the movable prop, cylinder prop and the cylinder; which effectively avoids stuck of the movable prop, is convenient and safe for operator, reduces labor intensity, and protects the three-way valve from damage in use. In dismounting, the top cover can be taken off without damaging other relevant parts only by dismounting the elastic cylindrical pin. The invention has the advantage of compact and reasonable structure, good stability, high strength of movable prop, high bearing capability, long and reliable work stroke, light weight of pillar, good sealing, good corrosion resistance, convenient mounting/dismounting, convenient use, long service life, low cost, good effect, and wide practicability.

| Symbols | |
|---|---|
| 1 | top cover |
| 2 | sealing cover |
| 3 | movable prop |
| 4 | handle valve body |
| 5 | oil cylinder |
| 6 | position-limiting steel wire |
| 7 | reset spring |
| 8 | oil inlet |
| 9 | bottom seat |
| 10 | pin |
| 11 | arc base |
| 12 | elastic cylindrical pin |
| 13, 18, 20, 24, 29 | sealing ring |
| 14, 19, 21, 25, 30 | retaining ring |
| 15 | dust-preventing ring |
| 16 | gasket |
| 17, 26 | guiding ring |
| 27 | three-way valve |
| 22, 23, 28 | connecting steel wire |

DETAILED DESCRIPTION OF THE EMBODIMENTS

The present invention will be further described with reference to the accompanying drawings:

Embodiment 1

Figure 1:
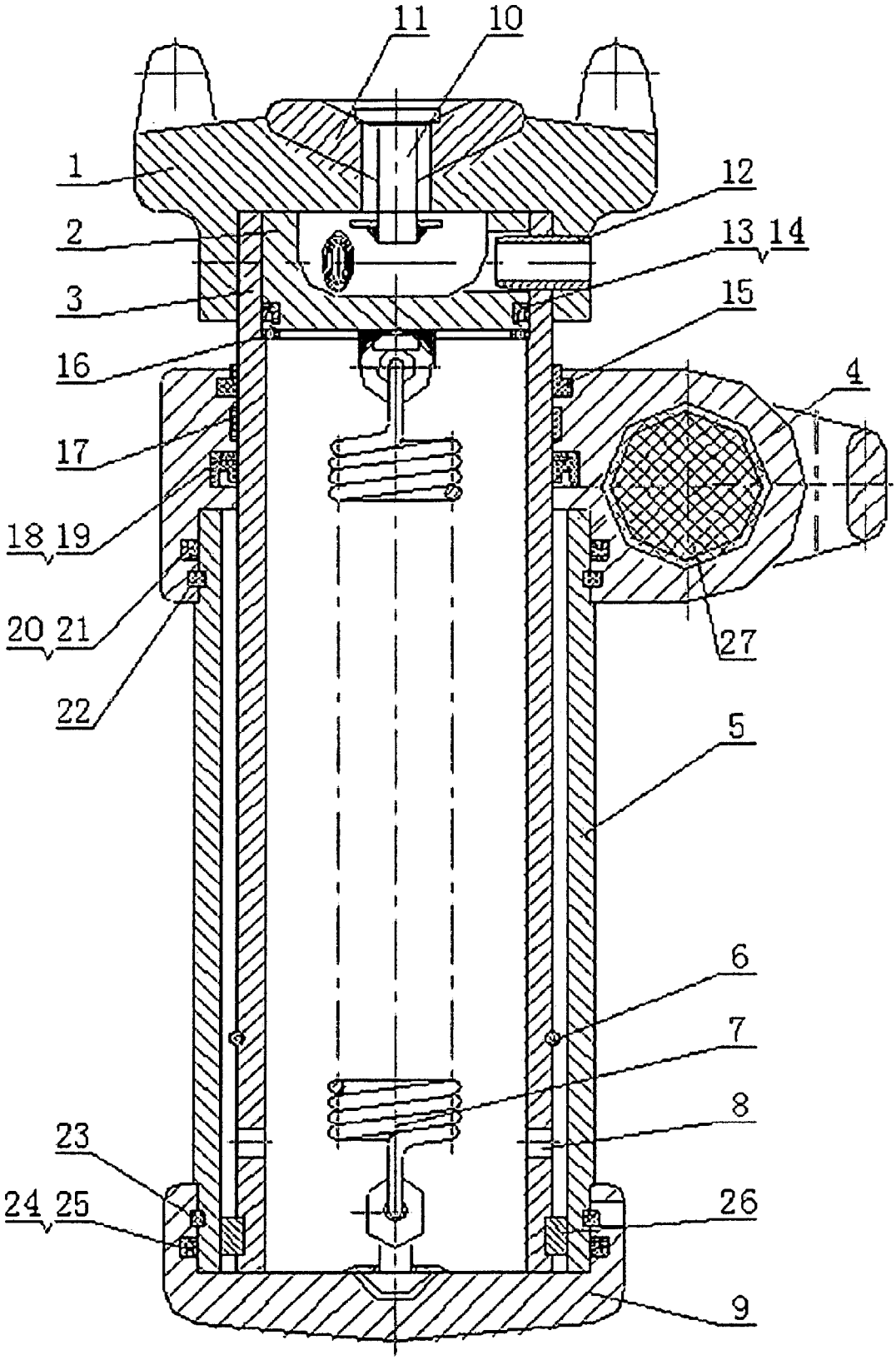
FIG. 1 is the section view of structure in embodiment 1.

As illustrated in FIG. 1, it mainly comprises top cover 1, sealing cover 2, movable prop 3, handle-valve body 4, oil cylinder 5, reset spring 7, and sealing members at each connection part. The top cover 1 is provided with arc base 11 rotatable along arbitrary directions and movably connected pin 10. The arc base 11 is arranged in groove of the top cover 1 square plate central part, center of the groove is provided with the pin 10 through the top cover 1 and making the arc base 11 and the top cover 1 be movably connected, tail of the pin 10 is fixed on a gasket by welding, and the pin 10 can move in the hole. Y-shaped sealing ring 13 and retaining ring 14 are provided between the sealing cover 2 and the movable prop 3, the sealing cover 2 is provided with gasket 16 at lower part, outer ring of the gasket 16 is against the shoulder of the movable prop 3 inner diameter, and multiple through holes are opened on the gasket 16 according to diameter thereof. The sealing cover 2 has a lower end face in planar shape, an upper end in bowl shape, the outer cylinder radial direction of the sealing cover (2) is provided with through hole matching drilling with the top cover (1) and the movable pillar (3); and elastic cylindrical pin 12 slightly movable along axial direction of the sealing cover 2 is arranged in the through hole. The movable prop 3 is arranged in the oil cylinder 5, the handle-valve body 4 is arranged between the cylinder 5 top and the movable prop 3. Dust-preventing ring 15, guiding ring 17, Y-shaped sealing ring 18, and retaining ring 19 are sequentially mounted between the handle-valve body 4 and the movable prop 3 fitting face. Y-shaped sealing ring 20, the retaining ring 21, and the connecting steel wire 22 for fixing the handle-valve body 4 are disposed between the handle-valve body 4 and the oil cylinder 5. Lower hook of reset spring 7 arranged in the movable prop 3 is arranged in hanging ring welded on the cylinder base seat 9, and the upper hook is disposed in hanging ring welded on the sealing cover 2 lower end. Outer cylindrical face of the movable prop 3 lower part is provided with position-limiting steel wire 6 and guide ring 26 which are fit in groove of the movable prop 3 outer cylindrical face. The handle-valve body 4 is provided with three-way valve 27, and oil inlet connecting the cylinder 5 and the three-way valve. The lower part cylinder of the movable prop 3 has multiple oil inlets 8 communicating with oil path of the oil cylinder 5. Y-shaped sealing ring 24 and the retaining ring 25 are disposed between the oil cylinder bottom seat 9 and the oil cylinder 5, which are closely jointed via the connecting steel wire 23.

Embodiment 2

Figure 2:
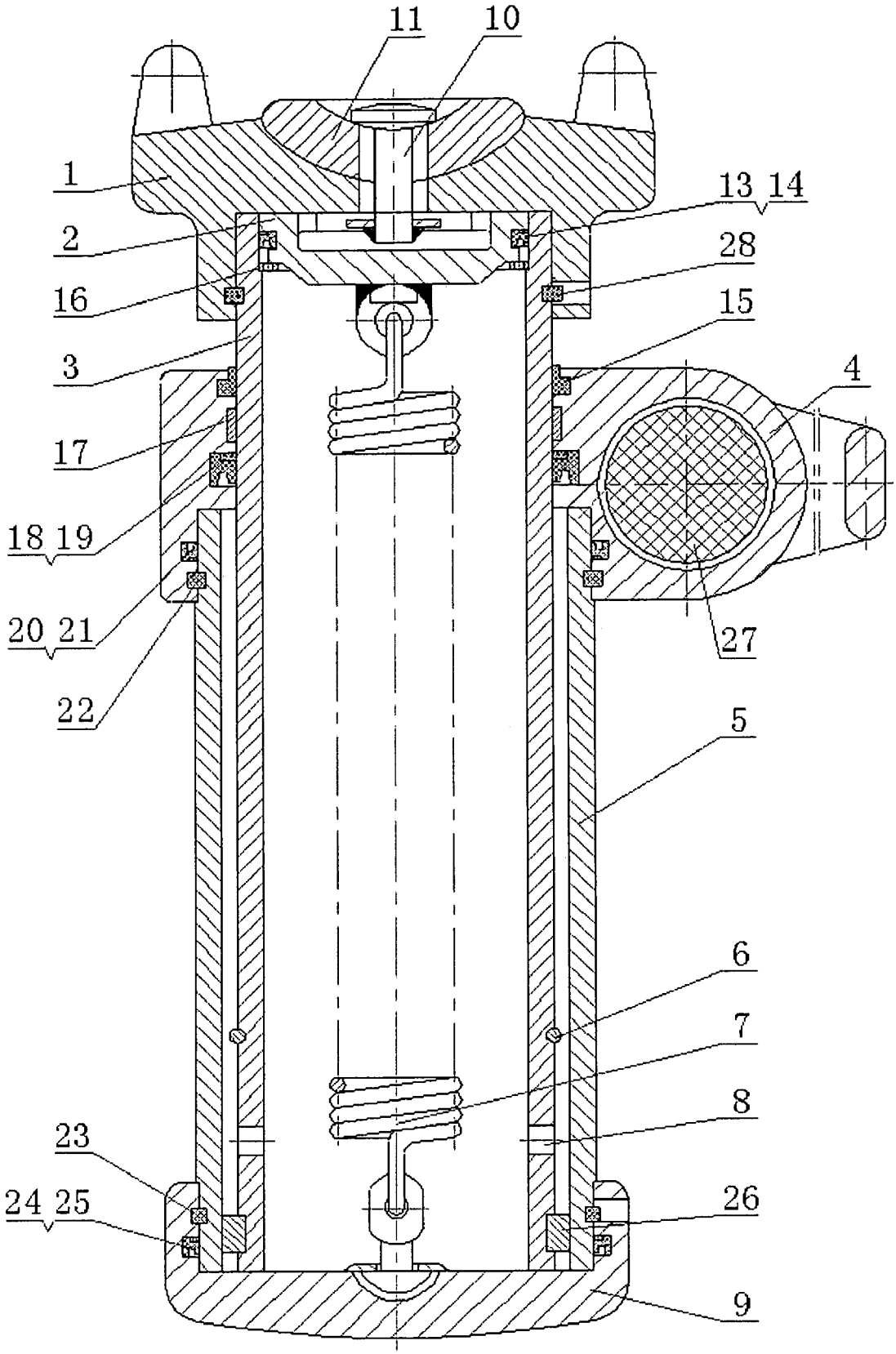
FIG. 2 is the section view of structure in embodiment 2.

As shown in FIG. 2, it is substantially the same as the embodiment 1, the only difference is in that the lower end face of the sealing cover 2 is cone flat bottom, the sealing cover 2 upper end face is opened with blind hole, only Y-shaped sealing ring 13 and gasket 14 are fitted between the sealing cover 2 and the movable prop 3 fitting face, and the top cover 1 is directly fixed with the movable prop 3 via connecting steel wire 28.

Embodiment 3

Figure 3:
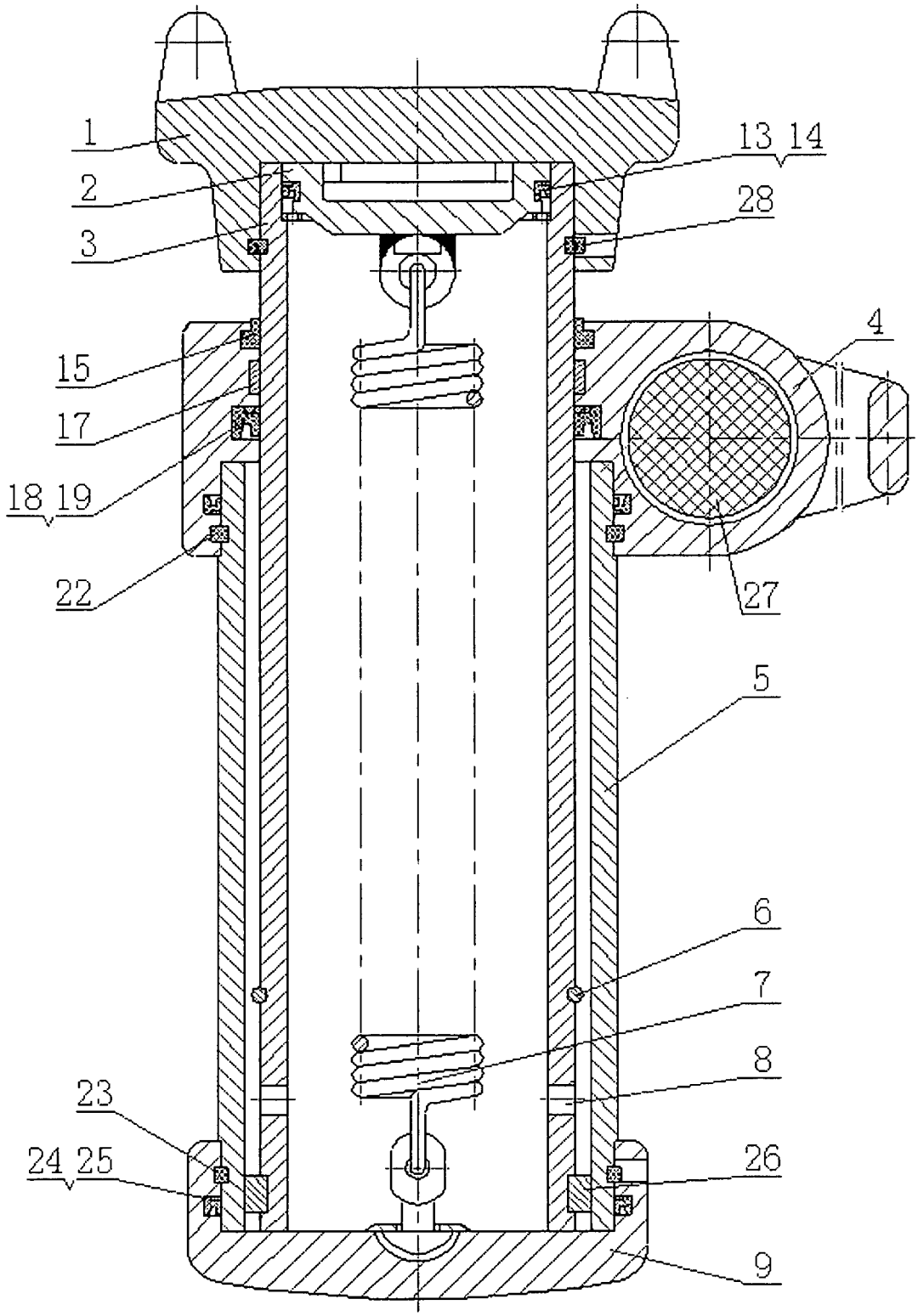
FIG. 3 is the section view of structure in embodiment 3.

As shown in FIG. 3, it is substantially the same as the embodiment 2, the only difference is in that the top of the top cover 1 is a flat plane, without arc base 11 rotatable along arbitrary direction and movably connected pin 10.

Embodiment 4

Figure 4:
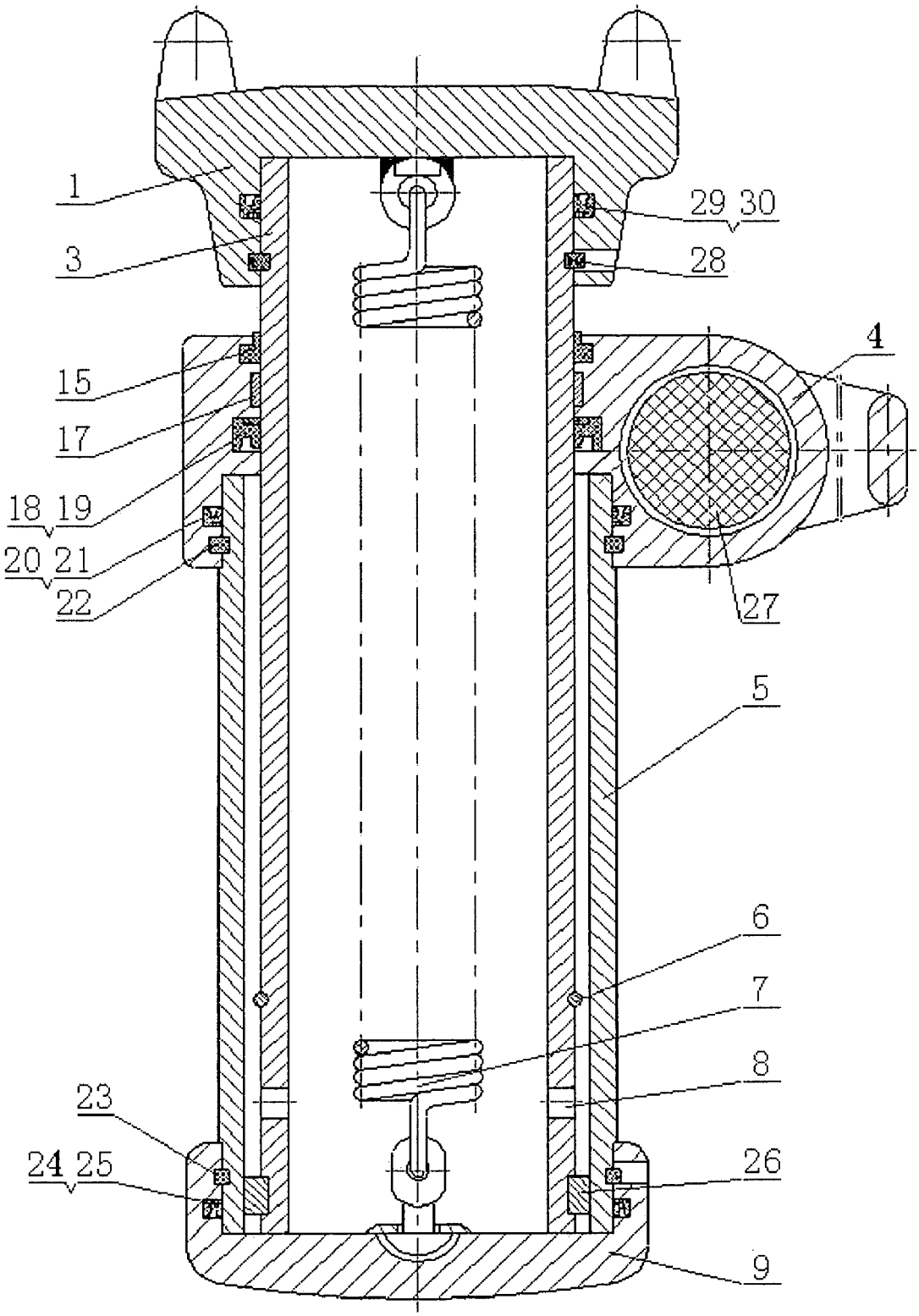
FIG. 4 is the section view of structure in embodiment 4.

As shown in FIG. 4, it mainly comprises top cover 1, movable prop 3, handle-valve body 4, oil cylinder 5, reset spring 7. The movable prop 3 is arranged in the oil cylinder 5, the handle-valve body 4 with three-way valve 27 is arranged between the oil cylinder port and the movable prop 3. Dust-preventing ring 15, guiding ring 17, Y-shaped sealing ring 18, and retaining ring 19 are sequentially mounted between the handle-valve body 4 and the movable prop 3. Y-shaped sealing ring 20 and the retaining ring 21 are disposed between the handle-valve body 4 and the oil cylinder 5, and the handle-valve body 4 are fixed on the cylinder 5 via the connecting steel wire 22. Oil inlet for communicating the oil cylinder 5 and the three-way valve is arranged on the handle-valve body 4. When the movable prop 3 moves up and down, the handle-valve body does not move along with it. Upper hanging ring connected with the reset spring 7 in the movable prop 3 is directly welded on inner wall of the top cover 1; lower hook of reset spring 7 is arranged in hanging ring welded on the cylinder base seat 9, and the upper hook is disposed in hanging ring in the top cover 1. Sealing ring 29, retaining ring 30, and connecting steel wire 28 for fixing are provided between the top cover 1 and the movable prop 3 fitting face. Outer diameter of the movable prop 3 is provided with position-limiting steel wire 6 and guide ring 26 which are fit in groove of the movable prop 3 outer diameter. Guide ring 17 is provided between the handle-valve body 4 and the movable prop 3. The lower part cylinder of the movable prop 3 has multiple oil inlets 8 communicating with oil path of the oil cylinder 5. Y-shaped sealing ring 24 and the retaining ring 25 are disposed between the bottom seat 9 and the oil cylinder 5, which are closely jointed via the connecting steel wire 23.

In application, oil is injected to pillar via three-way valve 27, the oil enters into annular cavity formed by the oil cylinder 5 and the movable prop 3 via through hole on the handle-valve body, and enters into the movable prop cavity via the through hole 8 of the movable prop 3 lower part, hence along with injection of the oil, when certain pressure is reached, the movable prop 3, the top cover 1, and the sealing cover 2 rise to a certain height for pillar support; when the pillar is lowered, under the action of reset spring, oil is discharged to annular cavity between the movable prop 3 and the oil cylinder 5 via radial through holes 8 at the movable prop 3 lower end, and is drained via the through hole on the handle-valve body 4 and the three-way valve thereon. The pillar is lifted and lowered once for each injection and drainage to finish one working cycle.

The invention claimed is:

1. A suspending hydraulic pillar, comprising:

a top cover (1);

an oil cylinder (5);

a movable prop (3) arranged in the oil cylinder (5);

a sealing cover (2) arranged in the movable prop (3);

a handle-valve body (4) arranged between a port of the oil cylinder and the movable prop (3);

a reset spring (7) connected with the sealing cover (2);

a first oil inlet (8) on the movable prop;

a three-way valve (27) arranged in the handle-valve body (4), a dust-prevention ring (15), a first sealing ring (18), a second sealing ring (20), and a first connecting steel wire (22) arranged between the handle-valve body (4) and the movable prop (3) and between the handle-valve body (4) and the oil cylinder (5);

a second oil inlet connecting the oil cylinder and the three-way valve;

a cylinder bottom seat (9) coupled to the oil cylinder (5);

a third sealing ring (24) and a second connecting steel wire (23) arranged between the cylinder bottom seat (9) and the oil cylinder (5);

a gasket (16) arranged below the sealing cover (2) in the movable prop (3), the gasket being provided with several through holes, an outer ring of the gasket (16) being disposed against a shoulder of an inner diameter of the movable prop (3);

a position-limiting steel wire (6) and a guiding ring (26) fitted on a groove of an outer diameter of the movable prop (3);

a guiding ring (17) provided between the handle-valve body (4) and the movable prop (3), a through hole in an outer cylinder radial direction of the sealing cover (2) that matches drilling with the top cover (1) and the movable prop (3), and an elastic cylindrical pin (12) arranged in the through hole.

2. The suspending hydraulic pillar as claimed in claim 1, wherein a lower end face of said sealing cover (2) is in the shape of a plane or a cone flat bottom.

3. The suspending hydraulic pillar as claimed in claim 1, wherein retaining rings are arranged in each of the first sealing ring, the second sealing ring, and the third sealing ring.

4. A suspending hydraulic pillar, comprising:

a top cover (1), a movable prop (3), an oil cylinder (5) cooperating with the movable prop (3);

a handle-valve body (4) arranged between a port of the oil cylinder and the movable prop (3), a reset spring (7) in the movable prop (3);

a first oil inlet (8) on the movable prop (3);

a three-way valve (27) arranged in the handle-valve body (4);

a dust-preventing ring (15), a first sealing ring (18), a second sealing ring (20), and a first connecting steel wire (22) provided between the handle-valve body (4) and the movable prop (3) and between the handle-valve body (4) and the oil cylinder (5);

a second oil inlet for communicating with the oil cylinder and the three-way valve;

a cylinder bottom seat (9) coupled to the oil cylinder (5);

a third sealing ring (24) and a second connecting steel wire (23) arranged between the cylinder bottom seat (9) and the oil cylinder (5);

an upper hanging ring arranged in the movable prop (3), connected with the reset spring (7), and directly welded on inner wall of the top cover (1);

a fourth sealing ring (29) and a third connecting steel wire (28) arranged between the top cover (1) and a fitting face of the movable prop (3);

a position-limiting steel wire (6) and a guide ring (26) arranged on an outer diameter of the movable prop (3) and fitted in a groove of the outer diameter of the movable prop (3); and a guiding ring (17) arranged between the handle-valve body (4) and the movable prop (3).

5. The suspending hydraulic pillar as claimed in claim 4, wherein retaining rings are arranged in each of the first sealing ring, the second sealing ring, and the third sealing ring.

* * * * *